US007770361B2

(12) United States Patent
Kessel et al.

(10) Patent No.: US 7,770,361 B2
(45) Date of Patent: Aug. 10, 2010

(54) POWDER COMPACTION AND ENROBING

(75) Inventors: Stephen Ronald Kessel, Cambridgeshire (GB); Jason Teckoe, Cambridgeshire (GB)

(73) Assignee: Bioprogress Technology International, Inc., Atlanta, GA (US)

( * ) Notice: Subject to any disclaimer, the term of this patent is extended or adjusted under 35 U.S.C. 154(b) by 1510 days.

(21) Appl. No.: 10/515,415

(22) PCT Filed: May 19, 2003

(86) PCT No.: PCT/GB03/02145

§ 371 (c)(1),
(2), (4) Date: Nov. 22, 2004

(87) PCT Pub. No.: WO03/096963

PCT Pub. Date: Nov. 27, 2003

(65) Prior Publication Data

US 2005/0220824 A1 Oct. 6, 2005

(30) Foreign Application Priority Data

May 21, 2002 (GB) ..... 0211620.0

(51) Int. Cl.
*B65B 1/24* (2006.01)

(52) U.S. Cl. ..... 53/438; 424/464; 53/439; 53/441; 53/453

(58) Field of Classification Search ..... None
See application file for complete search history.

(56) References Cited

U.S. PATENT DOCUMENTS

| | | | | |
|---|---|---|---|---|
| 2,663,128 | A | 12/1953 | Stirn, et al | |
| 4,567,714 | A * | 2/1986 | Chasman | 53/438 |
| 5,074,102 | A * | 12/1991 | Simpson et al. | 53/454 |
| 5,682,733 | A * | 11/1997 | Perrone | 53/560 |
| 6,245,350 | B1 * | 6/2001 | Amey et al. | 424/456 |
| 7,070,811 | B2 * | 7/2006 | Murphy et al. | 424/489 |

FOREIGN PATENT DOCUMENTS

| | | |
|---|---|---|
| EP | 0 691 121 A2 | 10/1996 |
| GB | 881022 | 11/1961 |
| WO | WO 01/15889 A1 | 3/2001 |
| WO | WO 02/098394 A1 | 12/2002 |

* cited by examiner

*Primary Examiner*—Robert A Wax
*Assistant Examiner*—Melissa S Mercier
(74) *Attorney, Agent, or Firm*—McDermott Will & Emery, LLP

(57) ABSTRACT

Powder, e.g. of a medicament, is compacted and enrobed to produce compacted powder slugs by preferably mechanically compacting a powder and forming a film of material, preferably hydroxy propyl methyl cellulose, by vacuum or pressure differential, about the surface of the powder thus compacted.

12 Claims, 4 Drawing Sheets

POWDER COMPACTION AND ENROBING

FIELD OF THE INVENTION

Figure 1:
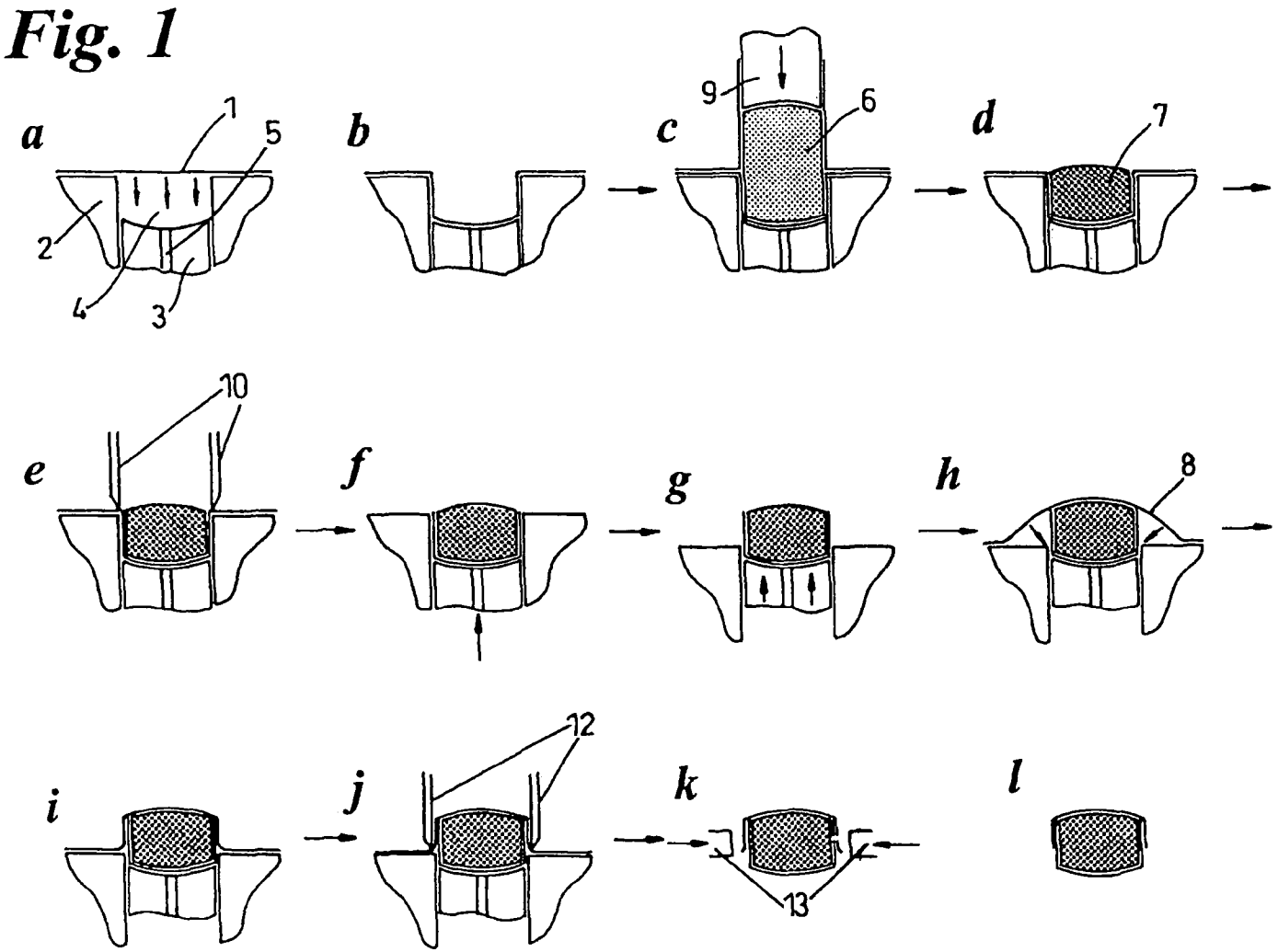

This invention concerns the compacting of powder e.g. a powder containing a medicament, vitamin, dietary supplement etc, and such compacted powder being enrobed by a biodegradable and/or water soluble film, for example a non gelatin film, such as hydroxypropyl methyl cellulose (HPMC), to produce encapsulated bodies of compacted powder, suitable for dosage forms, e.g. for human ingestion. The invention is applicable to all related dosage forms, including tablets, but for simplicity all such forms will be generally referred herein as capsules.

BACKGROUND TO THE INVENTION

Tablets are a common type of dosage form and various means for improving their properties have been tried. Current methods for coating tablets, such as pharmaceutical tablets include the using of acelacoaters or pan coaters, which spray low molecular weight HPMC grades onto tablets so imparting a surface layer, which is uniform and smooth, but opaque and of low gloss. It is possible for the tablets to have embossed lettering on them. This method of coating tablets is however very time consuming and requires a high level of expertise to produce satisfactory results. Production complications such as tablet twinning are common, where two tablets become attached to one another during the spray coating operation. In addition to these problems it is necessary to compact the tablets under relatively high pressures so that they do not disintegrate during the coating process. This high level of compaction can have an adverse effect on the disintegration and dissolution rates of active ingredients contained within the capsule, for example, leading to a delay in the release of a drug to a patient, whilst the tablet slowly dissolves in the stomach of the patient.

An alternative to spray or pan coating is to use two-piece hard capsules. These are produced by a dipping process, typically a HPMC solution is used, producing half shells which interlock and thus produce an enclosed capsule. These capsules are typically opaque but glossy, and cannot have any form of embossment, as this would interfere with the overlap interlocking process. The nature of the capsule dictates that there will always be an airspace above the powder fill level. Additionally, it is not possible to compact the powder into these tablets, and this so limits the quantity of powder which can be encapsulated. It follows that this lack of compaction can effectively reduce the amount of e.g. medicament which can be encapsulated. The existence of the air space in the capsule and lack of compaction of the powder contained within the capsule leads to a capsule that is inevitably larger than necessary.

It has also been found that, after manufacture and/or sale of two-piece hard capsules, the capsules can be easily and illegally interfered with, as it is possible to separate the two halves of the capsule and tamper with its contents and replace the two halves back together without there being any obvious change in the capsule's external appearance such to suggest to the user that there was anything wrong with the capsule. This means that it can be difficult to detect capsules which have had their contents tampered with.

HPMC and certain other non-gelatin materials are suitable for ingestion by humans, so delivery capsules with gelatin walls find potential use as ingestible capsules, e.g. for the delivery of accurately metered doses of pharmaceutical preparations and dietary supplements, as a possible replacement for gelatin based capsules. Conventional tablets have already been enrobed. See for example WO 02/098394.

SUMMARY OF THE INVENTION

One aspect of the invention concerns a novel method for compacting and enrobing a powder to produce capsules with enhanced properties.

A non gelatin film layer is thermoformed into a suitable tablet shaped pocket under the influence of heat and/or vacuum, and/or pressure. A pre-determined mass of powder is dosed into the film formed pocket, and compressed into a tablet shape e.g. with the aid of a piston or pistons. A partially enrobed 'soft' tablet results from this process, which is then fully enrobed by a second sequence of events which involves the raising of the tablet above a platten which allows the remainder of the compressed tablet to be enrobed by a second film. Suitable tablet shaped pockets can be created by using e.g. a pair of pistons slideable within a cylinder, such pistons also having the advantage of being able to form pinch points between the platen and the top of cylinders which are useful for cutting away unwanted excess film from the (partially) enrobed tablets.

One of the aims of the present invention is to produce tamper evident capsules.

Another aim of the present invention is to produce powder filled capsules whereby the powder is enrobed with a material which may or may not form a 'skin tight wrap'.

Another aim of the present invention is to produce a capsule with a high gloss surface which is able to adopt an underlying embossment, e.g. to identify a pharmaceutical tablet.

Another aim of the present invention is to produce capsules which have a flange which is almost non-discernable.

Another aim of the present invention is to enable the production of dosage forms in a wide variety of shapes and sizes, which, because of the nature of the processes involved and the properties of the product produced, includes shapes and sizes of dosage forms which have not been previously possible to make or practical to use.

Another aim of the present invention is to produce capsules with favourable properties and which contain powder or other flowable solid material which is at a favourable state of compaction and/or composition, and/or the encapsulating medium of the capsule being fast dissolving or dissolvable (with control) pharmaceutical grade films plasticised with pharmaceutical grade materials.

Another aim of the present invention is to produce capsules, which by their nature, are easy to swallow, and more easily can be conveyed to the site where it is desirable where the active ingredients are most advantageously released.

Another aspect the present invention is a method of powder compaction to produce powder compacted slugs, which, for example can be enrobed to produce capsules which possess enhanced disintegration and dissolution properties over and above traditional tablets.

Another aspect of the present invention is a method of producing a capsule, which, at the very least can perform the same function as a conventional coated tablet, but in which the conventional tablet pressing and coating stages are replaced by a single powder enrobing process.

Another aspect of the present invention is a method of producing a capsule by enrobing powder, in which, because of the nature of capsule produced, certain ancillary ingredients necessary in conventional tablet production, can be omitted. For example, ingredients in a tablet which are added to give the tablet its structural integrity can be omitted, because the active ingredients are in powder form, relatively loosely compacted are encapsulated within a film, such film which now securely packages the powder/ingredients, thus giving integrity and forming a discrete effective dosage form. Because of the aforementioned, components contained within a tablet which are designed to disperse and break up the tablet when it has reached the site of delivery, can be omitted, as the active ingredients in the capsule according to the present invention are in a non-compacted or at least less compacted form as compared to a conventional tablet, and this lesser compaction leads to the easy release and dispersal of active ingredients once the capsule film has dissolved, e.g. at the intended site of delivery.

Another aspect of the invention provides a method of enrobing compacted powder, comprising vacuum forming a film into a pocket, compacting a powder in said pocket, resulting in a partially enrobed powder slug in a pocket. Vacuum forming a second film over this powder slug to completely enrobe the powder slug, forms a discrete compacted powder filled capsule, suitable for use as a dosage form.

In yet another aspect of the present invention provides a method of enrobing compacted powder using film or films, to form a compacted powder filled capsule, wherein the film or films forming the wall of the compacted powder filled capsule used overlap each other.

In a further aspect of the present invention provides a method of forming and/or enrobing a compacted slug wherein the level of compaction of the compacted powder is less than that necessary to reach the industry standard for the discrete slug of compacted powder to be described as a tablet.

In practising the method of the invention, the films are caused to deform to conform with the external surface of the pocket and the compacted powder slug, the films effectively forming a secure capsule, by being wrapped around the powder slug. Vacuum chamber or vacuum bed apparatus, in which the films and powder are located in a suitably shaped support and exposed to conditions of vacuum (or substantially reduced pressure) can be modified and used for this purpose. Such apparatus may be based on commercially available vacuum chamber or vacuum bed apparatus, suitably modified. Vacuum forming techniques result in the compacted powder being completely enclosed and encapsulated within a film, leading to a capsule containing compacted powder, such capsule having enhanced and controllable properties over dosage forms currently available, such as conventional tablets. The powders to be compacted are typically subjected to pressures between, but not limited to, 5-15 mega pascals. Examples of powders compacted and enrobed include paracetamol, ibuprofen, sorbitol and multivitamin. Other powder fills which are contemplated are antacid, anti-inflammatory, anti-histamine antibiotic and anti-cholesterol drugs.

The film should be a material which is suitable for human consumption and that has sufficient flexibility and plasticity to be vacuum formable. Some film materials have suitable properties in their natural condition, but commonly it will be necessary to pre-treat the film material so that it is vacuum formable. For example, it may be necessary to expose the film material to a solvent therefor; for instance certain grades of polyvinyl alcohol (PVA) will vacuum form after application of a small amount of water to the surface thereof or when exposed to conditions of high humidity. A further generally preferred possibility, is to use a film of thermoplastic material (i.e. material capable of deforming plastically on heating) with the film to be in heat-softened condition prior to being thermoformed by exposure to vacuum. Suitable thermoplastic materials include modified cellulose materials, particularly hydroxypropyl methyl cellulose (HPMC) and hydroxypropyl cellulose (HPC), polyvinyl alcohol (PVA), polyethylene oxide (PEO), pectin, alginate, starches, and modified starches, and also protein films such as soya and whey protein films. The currently preferred film material is HPMC. Suitable film materials are currently available.

When using thermoplastic film, the film is typically heated prior to application to pocket or compacted powder slug, so that the film is in a heat softened deformable condition. This can be achieved by exposing the film to a source of heat e.g. an infrared heater, infrared lamps, a heated plate a hot air source etc. In the process described, a range of temperatures may be used, but by way of example only, where films of different thickness may be utilized for the first and second films in the process, a first film forming temperature of around 150 degrees centigrade may be used and for the second film forming stage, a range of approximately 70-80 degrees centigrade may be used.

During the enrobing process, films may be caused to overlap, preferably a minimum of 1.5 mm-2 mm. Compacted powder slugs may preferably have a sidewall height of about 3 mm and films may be caused to overlap substantially completely over the sidewall area.

The film material may include optional colourings, e.g. in the form of food dyes such as FD and C yellow number 5, and/or optional flavourings, e.g. sweeteners, and/or optional textures etc in known manner.

The film material typically includes plasticiser to give desired properties of flexibility to the film in known manner. Materials used as plasticisers include alpha hydroxy acids such as lactic acid and salts thereof, maleic acid, benzyl alcohol, certain lactones, diacetin, triacetin, propylene glycol, glycerin or mixtures thereof. A typical thermoplastic film formulation is HPMC 77% by weight, plasticiser 23% by weight.

The film suitably has a thickness in the range 20-200 microns, conveniently 50 to 100 microns, e.g. at about 80 microns, with appropriate film thickness depending on factors including the size and form of the tablet. Films of different thickness may be used, e.g. a film of greater thickness may be used in the first stage of the enrobing process, say 125 microns thickness and a film of lesser thickness may be used in the second stage of the enrobing process, say 80 microns thickness.

Because of the nature of the film forming process according to the present invention, under certain circumstances, e.g. where the powder to be compacted contains particles which, under compaction, have the ability to pierce film, it may be advantageous to have the thickness of the film formed in the pocket to be greater than that of the film which is to cover the remainder of the compacted powder slug (in the second and final phase of enrobement of the compacted powder). Such differential thickness may give rise to certain advantageous structural features of the resultant capsule; the capsule my be generally more robust and so may be more safely stored and handled (generally thicker film on the capsule), but such capsule also possessing a smaller area (window) of weaker, thinner film which can give rise to quicker release characteristics by the thinner film will dissolving more quickly when exposed to any given solvent. An advantageous differential film thickness to form a capsule with wall of different thickness, could be e.g. 70/90 micron film coordination to produce capsules which are robust but which release their contents quickly, through a window of thinner film.

Therefore films of different thickness may be used in the enrobing process, and to give a further examples, a film of greater thickness may be used in the first stage of the enrobing process, a maximum of 200 microns and a minimum of 70 microns but say preferably 125 microns thickness and a film of lesser thickness may be used in the second stage of the enrobing process, a maximum of 125 microns and a minimum of 50 microns, but say preferably 80 microns thickness. When making multiples of enrobed compacted powder slugs; the spacing of the compacted powder slugs can be important. If the compacted powder slugs are positioned too closely together, the film is not able to fully thermoform between them. For example, a spacing between the adjacent compacted powder slugs of about 4 mm has been found to give good results, the film being able to fully adopt the vertical sidewall of the compacted powder slug to a distance of about 2 mm before it begins to curve away from the side of the compacted powder slug.

According to one aspect of the invention, the method involves forming two separate overlapping half coatings of film, effectively on the compacted powder slug. The method preferably involves, first forming a film in a pocket, then compacting a powder slug into the film lined pocket, thereby effectively coating/encapsulating a substantial portion of a powder slug within a film formed into a partial capsule, removing the remaining film material not coating the compacted powder slug e.g. by cutting, then coating the remaining half of the compacted powder slug, with overlapping portions of the two coatings sealed together to provide a sealed complete enclosure for the slug, and again removing remaining surplus film material not coated on the slug. It may be necessary to apply adhesive material between the overlapping film coatings e.g. to the surface of the film layers, to ensure the formation of an effective seal therebetween and to make the resultant capsule tamper-evident. The adhesive material conveniently has the same composition as the film, but with a greater proportion of plasticiser, e.g. 93% to 98% by weight plasticiser, so as to provide a less viscous material. The adhesive material may be applied, e.g. by use of a roller, spraying etc. A typical adhesive formulation, with % representing % by weight, is HPMC 4%, lactic acid 77%, water 19%.

The compacted powder slug and capsule conveniently include a generally cylindrical side wall portion, with two half coatings overlapping on this side wall. Tablets of circular symmetrical form with a circular cylindrical side wall are very common, but other forms e.g. generally oblong and oval, again including a generally cylindrical side wall, are also known.

It may be also advantageous or desirable to apply adhesive material e.g. as described above, to the surface of compacted powder slug prior to the final stage of coating, to promote adhesion of the second portion of the film thereto. Again, this may be achieved by e.g. use of a roller, spraying etc.

A plurality of tablets in an array may be conveniently coated simultaneously, using a suitably large sheet of film material.

This invention is now further described in detail, by way of example only, with reference to the drawings. Steps a-k show the basic compaction and enrobing apparatus and process.

The drawings show the various stages of a powder compaction/enrobing process.

FIG. 1 shows the mechanism of the basic steps of powder compaction and enrobement via steps a-l:

a. A first film (1) is laid upon a platten (2). Lower piston (3), slideable in cylinder (4) incorporates vacuum port (5).
b. Film (1) completely drawn down into cylinder (4) by a vacuum created by vacuum port (5) and said film (1) also resting on the crown of lower piston (3), to form a pocket shape.
c. A quantity of powder (6) is introduced over the pocket of film and upper piston (9) moves downward towards the lower piston (3) compressing a quantity of powder (6).
d. A compacted powder slug (7) resulting from the completion of step c.
e. Cutting of film by the introduction of cutting tool (10) to form an isolated semi enrobed slug of compacted powder.
f. Lower piston (3) begins to move upwards, thereby also urging compacted powder slug (7) upwards.
g. Lower piston (3) comes to rest, positioning compacted powder slug (7) proud of platen (2)
h. Introduction of a second film (8) over platen (2) and also loosely stretching over compacted powder slug (7)
i. Second vacuum is applied drawing second film (8) around and closely in association with the upper portion of compacted powder slug (7), second film (8) thereby wrapping itself around the upper part of the compacted powder slug (7).
j. Cutting tool (12) descending and trimming off excess unwrapped film from powder slug (7).
k. Fully enrobed powder slug, has been ejected from cylinder (4) by the further upward movement of lower piston (3) and has the loose ends of the films ironed and sealed by irons (13).
l. Shows a fully enrobed tablet with ironed seams.

Figure 2:
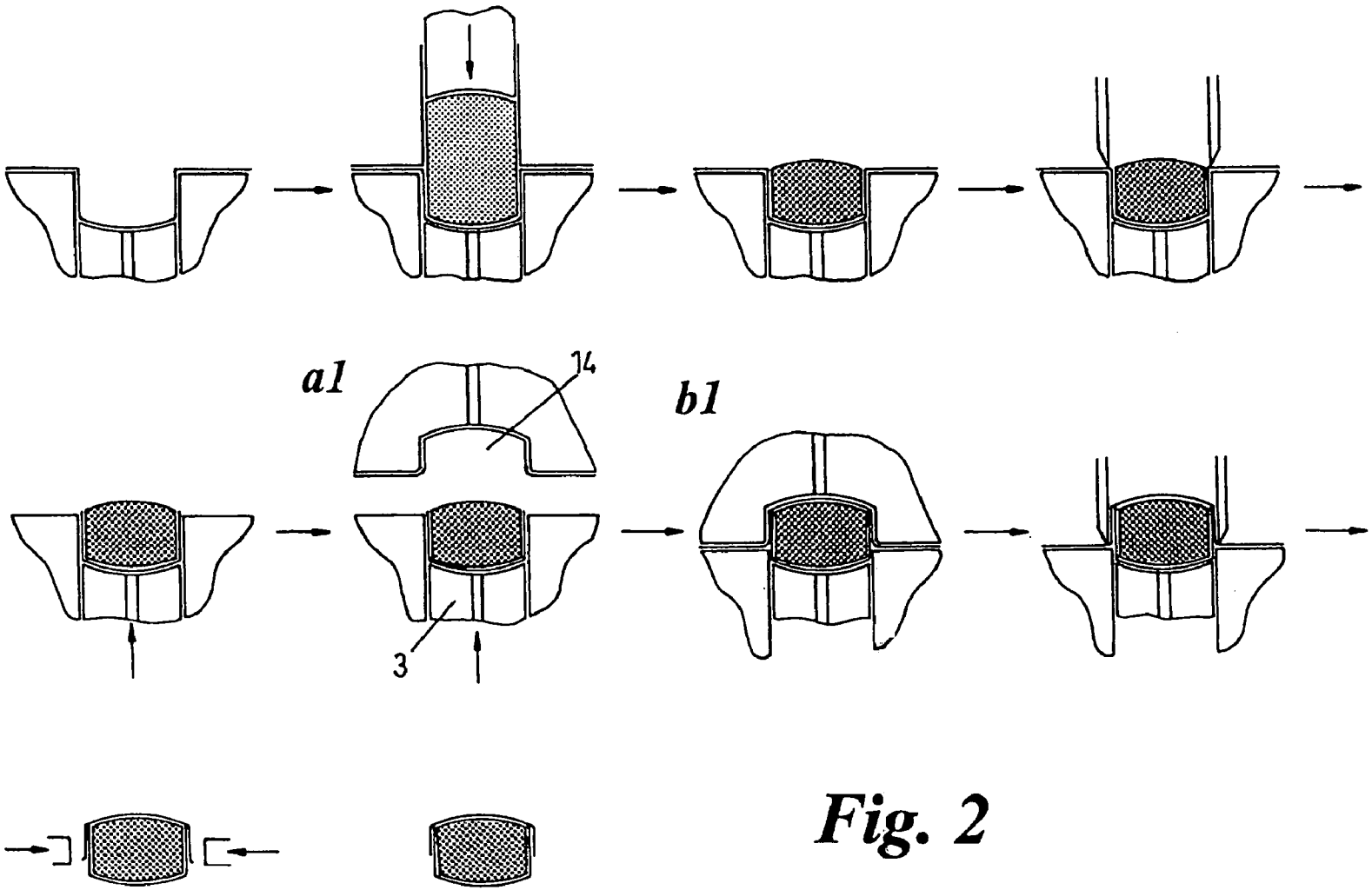

FIG. 2 depicts a variation of the basic process described by FIG. 1.

Steps a1 and b1 show a second pre-formed film pocket, formed by a second vacuum forming pocket (14) being lowered onto the platten immediately above a partially enrobed powder slug as shown in step f of FIG. 1. Once the opposing film pocket is in position lower piston (3) moves upwards thus pushing compacted partially enrobed powder slug also upwards and into the cavity of the second pre-formed film pocket, thus capping the partially enrobed powder slug to form a fully enrobed capsule, enrobed by two pockets of film. The capsule is then released, trimmed and ironed as mentioned previously.

Figure 3:
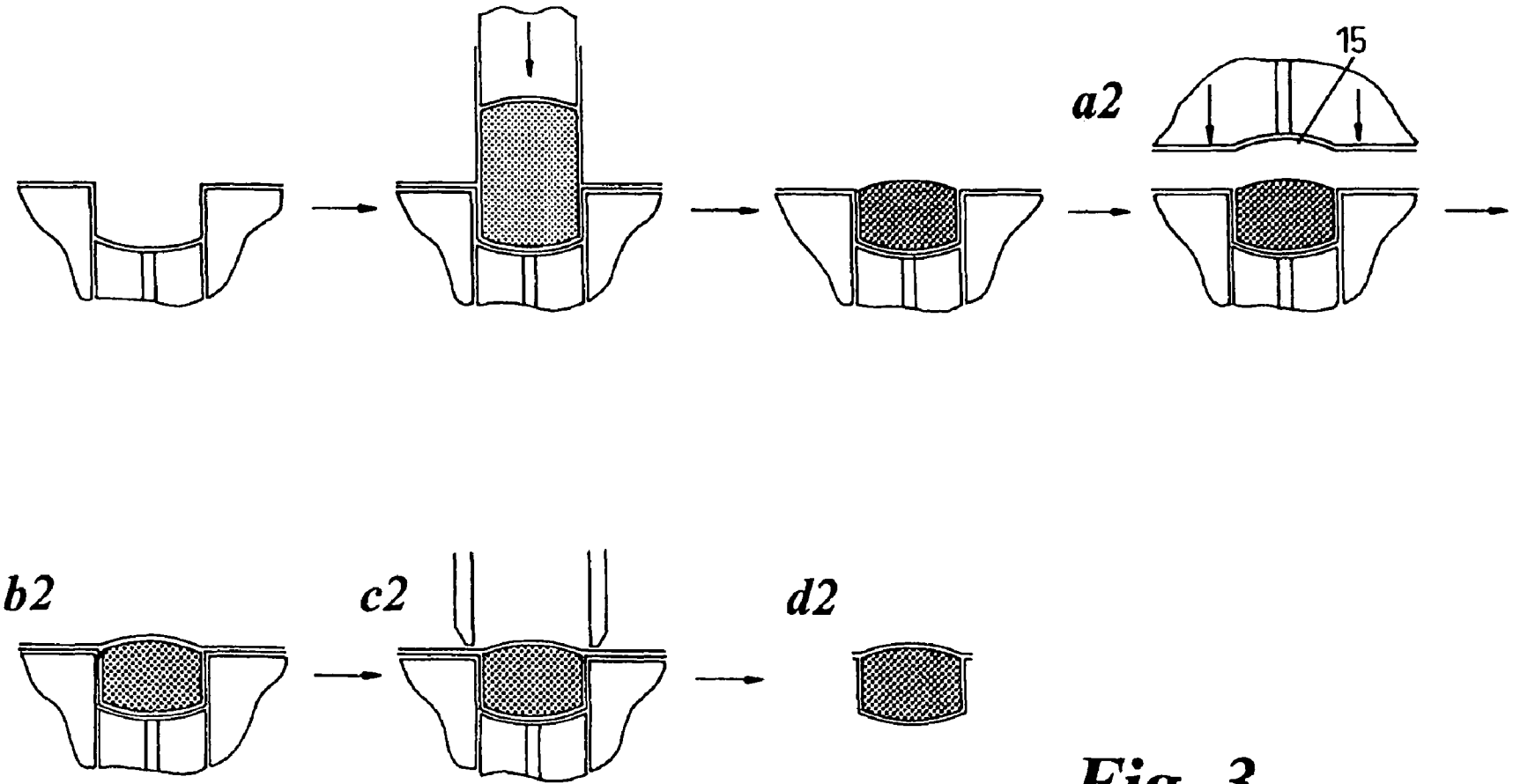

FIG. 3 depicts a further variation of the basic process described by FIG. 1.

Step a2 shows a powder slug as in step f of FIG. 1, and like FIG. 2 a second pre-formed film pocket is introduced, but this time it is a shallow pocket, formed by a second shallow vacuum forming pocket (15), such to only coat the top of the powder slug and to form a seal at the circumference of the very edge of the cylindrical portion of the powder slug. Steps a2-d2 show this revised process. This process gives rise to a capsule with a different type of seal which gives rise to different properties in the capsule.

Figure 4:
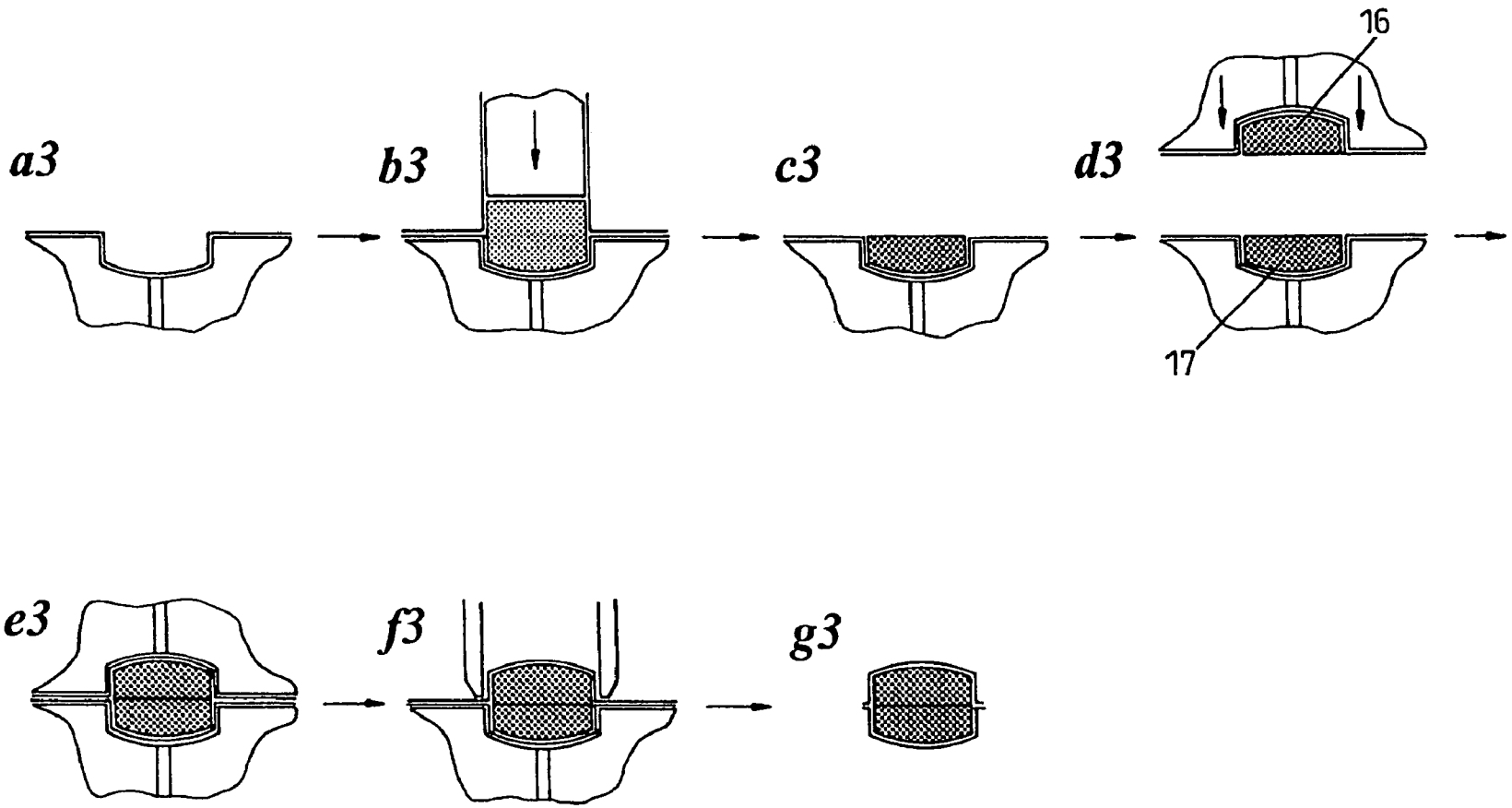

FIG. 4 depicts another variation of the process described by FIG. 1.

However the basic process is essentially duplicated to form a capsule which contains two distinct half doses of powder. The basic process as described in FIG. 1 is carried out up to step f, in duplicate, which is basically steps a3-c3 in FIG. 4. The main differences at this point in FIG. 4, are that the two opposing pockets filled with compacted powder (16,17) are half size in depth, and the top of the powder slugs are essentially flat, rather than rounded. Step c3 may include the laying down of an intermediate film on the surface of the half slug. Steps d3-f3 show the bringing together of 2 half slugs to form a single capsule, comprised of 2 parts. Step g3 shows a compartmentalized capsule. The advantages are at least 2 separate doses of active ingredients can be incorporated into 1 capsule, under perhaps different compaction pressures etc. This gives rise to further flexibility and options as to the performance of the new dosage forms.

The process described, and in conjunction with the quantity of powder used, with the careful positioning of the co-acting pistons during the compaction process, can facilitate the formation of powder slugs having various levels of compaction. As previously described, these varying levels of compaction are allowed in the powder slugs because the slugs are enrobed within a film, and it is this film enrobement which provide the slug with the necessary integrity it needs so that it can function as a convenient and stable dosage form. The process and apparatus can be modified such to produce capsules with varying properties, which have advantages over tablets and conventional capsules already known in the art. For example, a capsule according to the present invention containing a powder with a low compaction, could produce extremely favourable quick release characteristics, suitable, e.g. for a fast acting-analgesic; the film can be both designed to be smooth/flexible, to allow the capsule to quickly and relatively painlessly travel to the intended site of drug delivery through the digestive tract, and also be designed to dissolve at or near the intended site of drug delivery. The lower compaction of the powder in the capsule can also aid smooth travel of the capsule in the digestive tract, as the contents of the capsule can be designed to be compressible and mobile, thus allowing the capsule to be bent and/or compressed as it travels through the body so that it can conform to the shape of a more restricted part of a passage, squeeze through it and so continue its journey through the digestive tract with less hindrance. Such dosage forms may find themselves especially useful where a patient finds difficulty in swallowing, has a painful or restricted digestive tract, or there is some other reason why a dosage form is required to be more mobile and less aggressive to the internals of the body.

The following methods are given by way of example and it is not intended to limit the invention in any way:

EXAMPLE 1

Consumable Items:

Film 1—125 micron thickness, hpmc plasticised with lactic acid 15%, and triacetin 5%, processing aids starch 1% and sorbitol monostearate 0.25%.

Film 2 as film 1 but 80 micron thickness.

Glue applied to overlap area of first film—benzyl alcohol 45%, triacetin 50%, hpmc E15 Premium (Dow Chemical Corp.) 5%

Process Description

Film 1 is thermoformed into single or multiple tablet/caplet shaped pockets in a platen, each pocket containing a lower piston that can be raised or lowered as necessary to suit standard sized tablets and caplets. The tablet shaped pocket also has a raised edge profile around the top perimeter of the pocket. This edge profile is raised 1 mm above the platen surface and has a land width of 0.35 mm. The vertical sidewall of these pockets is typically 3 mm deep.

The thermoforming operation involves the film acting as a membrane dividing the two halves of a vacuum chamber, which are separately controlled. The chamber above the film contains a flat heated platen at a temperature of approximately 150° C. Vacuum is drawn above the film causing it to be held against the heated plate for a period of 1 to 5 seconds preferably 3 seconds. The vacuum in the upper chamber is maintained whilst vacuum is also applied to the lower chamber. At this stage the film remains against the heated platen. Once the vacuum level in the lower chamber reaches at least −0.65 bar the vacuum in the upper chamber is released to atmosphere or replaced by positive pressure, this forces the film downwards away from the heated platen and onto the tablet pocket shaped tooling below. In this way the film adopts the shape of the tablet pockets in the lower tooling.

Powder Dosing and Film 1 Cutting

A dosing assembly is then placed over the film formed pocket. This consists of a location mask which sits on location dowels in the platen, and a dosing sleeve that rests directly above the film formed pocket, and sits on the raised edge profile. The dosing sleeve exactly matches the dimensions of the film formed pocket. A dose of powder is deposited into the dosing sleeve and falls into the film pocket. Compaction is achieved via a compaction piston that advances through the dosing sleeve and sweeps any residual powder down into the film pocket below and compacts it to a fixed stop, such that it does not cut the film, but instead comes to rest directly adjacent to the film. The level of compaction is controlled by the mass of powder being deposited into the dosing sleeve. The piston below the compacted powder tablet is then lowered and either the compaction piston is advanced by a similar amount causing a punch cut through the film as it interferes with the inside of the raised edge profile. Alternatively the compaction piston is replaced by a cut piston which similarly advances and causes a punch cut with the raised edge profile. The fit tolerance between the cut piston and the internal dimensions of the raised edge profile are such that the diametric clearance is no more than 35 microns.

The apparatus is generally of stainless steel, with the piston crowns made of hardened steel. The equipment was machined and supplied by Midland Tool and Design, Birmingham, UK.

The tablet is thus pushed down by the cut piston into the confines of the pocket, and comes to rest on the lower piston. The location mask and dosing sleeve and the waste film web are then removed.

Second Film Application, Cut and Iron

The partly enrobed core is then raised upwards within the tooling, such that half of the formed tablet sidewall is above the raised edge profile. The second film has 15 gsm of glue applied to its surface via gravure roller and this is advanced over the tablets. The film is then thermoformed in the same manner as described for the first film, except that the film is held above the tablets by a spacer plate, such that the positioning of the film does not damage the top surface of the tablet. It is possible to use a lower heated platen temperature (50-150° C.) for the second thermoform, as the film is thinner and softened by the application of glue. This helps to limit the heat exposure of the powder surface. The location mask is then positioned over the tablet and a second cut piston is lowered. The second cut piston is designed such that it forms a punch cut on the outside edge of the raised edge profile of the lower tooling, with a diametric fit tolerance of no more than 25 microns. The location mask, and second cut piston and waste film web are then removed and the fully enrobed powder core is pushed through a tight fitting tablet shaped heated cylinder (40° C.) to ensure the overlap seal is formed.

EXAMPLE 2

Same conditions as Example 1, but the following step replaces 'Powder dosing and film 1 cutting' stage:

Powder Dosing and Film 1 Cutting

A dosing assembly is then placed over the film formed pocket. This consists of a location mask which sits on location dowels in the platen, and a dosing sleeve that rests directly above the film formed pocket, and sits on the raised edge profile. The dosing sleeve exactly matches the dimensions of the film formed pocket. A dose of powder is deposited into the dosing sleeve and falls into the film pocket. The cut is achieved via the cut piston that advances through the dosing sleeve and sweeps any residual powder down into the film pocket below. The level of compaction is controlled by the mass of powder being deposited into the dosing sleeve. The cutting piston cuts through the film as it interferes with the inside of the raised edge profile. The cut piston continues to engage with the raised edge for a further 1 mm, and in so doing compacts the powder further into the film shell. The fit tolerance between the cut piston and the internal dimensions of the raised edge profile are such that the diametric clearance is no more than 25 microns.

The apparatus is generally of stainless steel, with the piston crowns made of hardened steel. The equipment was machined and supplied by Midland Tool and Design, Birmingham.

The tablet is thus pushed down by the cut piston into the confines of the pocket, and comes to rest on the lower piston. The location mask and dosing sleeve and the waste film web are then removed.

EXAMPLE 3

Same as example 1, but the tolerance fit for the first cut piston is the same as that for the second cut piston, i.e 25 microns.

EXAMPLE 4

Same as example 2, but the tolerance fit for the first cut piston is the same as that for the second cut piston, i.e 25 microns.

The invention claimed is:

1. A method of forming a compacted powder slug encapsulated with a film, comprising:

forming a film into a pocket using vacuum and/or pressure;

compacting a powder into the pocket resulting in a partially enrobed powder slug, wherein at least 15% and a maximum of 99% of the powder slug is enrobed;

raising the partially enrobed powder slug above a platten to allow the remainder of the powder slug in said pocket to be enrobed; and enrobing the remainder of the powder slug.

2. A method according to claim 1, wherein the film comprises thermoplastic material which is heated prior to being vacuum formed.

3. A method according to claim 1 wherein the means for compacting the powder is mechanical.

4. A method according to claim 3 wherein said mechanical means for compacting the powder utilizes one or more pistons.

5. A delivery capsule having an enclosing wall and a powder slug core according to claim 1.

6. A delivery capsule according to claim 5 whereby the films forming the enclosing walls are overlapping.

7. A delivery capsule according to claim 5 wherein the delivery capsule has one or more overlapping flanges.

8. A delivery capsule in accordance with claim 5 wherein the films used or the enclosing wall of the capsule, are made from a non gelatin polymeric material, modified cellulose material, starch material, modified starch material or protein films or graft copolymers of polyethylene oxide with side chains polyethylene oxide.

9. A delivery capsule in accordance with claim 5 wherein the films used or the enclosing wall of the capsule, are made from hydroxypropyl methyl cellulose (HPMC), hydroxypropyl cellulose (HPC), polyvinyl alcohol (PVA), polyethylene oxide (PEO), pectin, alginate, soya or whey protein.

10. An enrobed powder slug according to claim 1.

11. A method according to claim 1, wherein the films used or the enclosing wall of the capsule are made from a non gelatin polymeric material, modified cellulose material, starch material, modified starch material or protein films or graft copolymers of polyethylene oxide with side chains of polyethylene oxide.

12. A method according to claim 1, wherein the films used or the enclosing wall of the capsule are made from hydroxypropyl methylcellulose (HPMC), hydroxypropyl cellulose (HPC), polyvinyl alcohol (PVA), polyethylene oxide (PEO), pectin, alginate, soya or whey protein.

* * * * *